US007005619B2

(12) United States Patent
Fujii et al.

(10) Patent No.: US 7,005,619 B2
(45) Date of Patent: Feb. 28, 2006

(54) INDUCTION HEATING DEVICE, INDUCTION HEATING FIXING DEVICE AND IMAGE FORMING APPARATUS

(75) Inventors: Makoto Fujii, Chiyoda-ku (JP); Ken Tanino, Chiyoda-ku (JP); Yasuhiro Ohno, Chiyoda-ku (JP); Masami Miyazaki, Chiyoda-ku (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 18 days.

(21) Appl. No.: 10/810,894

(22) Filed: Mar. 29, 2004

(65) Prior Publication Data

US 2005/0067408 A1 Mar. 31, 2005

(30) Foreign Application Priority Data

Sep. 30, 2003 (JP) ..... 2003-339756

(51) Int. Cl.
*H05B 6/14* (2006.01)
*G03G 15/20* (2006.01)

(52) U.S. Cl. ..... 219/619; 219/670; 219/672; 399/328; 399/330

(58) Field of Classification Search ..... 219/619, 219/670, 661–663, 672–676; 399/328–338
See application file for complete search history.

(56) References Cited

U.S. PATENT DOCUMENTS

| | | | | |
|---|---|---|---|---|
| 5,666,627 | A * | 9/1997 | Yamaguchi | 399/330 |
| 6,246,843 | B1 | 6/2001 | Nanataki et al. | |
| 6,373,036 | B1 * | 4/2002 | Suzuki | 219/619 |

FOREIGN PATENT DOCUMENTS

| | | |
|---|---|---|
| JP | 2001-060490 | 3/2001 |
| JP | 2001-135470 | 5/2001 |

* cited by examiner

*Primary Examiner*—Philip H. Leung
(74) *Attorney, Agent, or Firm*—Morrison & Foerster LLP

(57) ABSTRACT

An induction heating device for inductively heating an object to be heated which is formed of conductive material has a holder. The holder is positioned outside the object. The device has an exciting coil for inductively heating the object. The exciting coil is supported by the holder. The exciting coil is composed of a plurality of turns of conductor forming a layer, which is positioned along the object. The device also has a demagnetizing coil which is positioned along the layer of the exciting coil. In the demagnetizing coil, a back electromotive force is induced in accordance with a magnetic field produced by the exciting coil, so as to cancel the magnetic field. Stability in the temperature control for the object such as a heating roller can be improved by effective function of the demagnetizing coil. The device can be miniaturized and configured at low cost.

11 Claims, 10 Drawing Sheets

PRIOR ART

INDUCTION HEATING DEVICE, INDUCTION HEATING FIXING DEVICE AND IMAGE FORMING APPARATUS

This application is based on an application No.2003-339756 filed in Japan, the contents of which are hereby incorporated by reference.

BACKGROUND OF THE INVENTION

The present invention relates to an induction heating device for inductively heating an object to be heated which is formed of conductive material.

The invention also relates to an induction heating fixing device of induction heating type for fixing to a sheet a toner image formed on the sheet while conveying the sheet.

The invention also relates to an image forming apparatus having an image forming unit for forming a toner image on a sheet and an induction heating fixing device of induction heating type for fixing to the sheet the toner image formed on the sheet while conveying the sheet having the toner image formed thereon by the image forming unit. Among image forming apparatus of this type are copying machines, laser printers, facsimiles and the like, typically.

In a typical fixing device of induction heating type, region which is heated by exciting coils with respect to axial direction of heating roller (corresponding to width direction of sheet) (the region will be referred to as "first heating width") is determined in accordance with the sheet having the largest width that is fed to the device. That is intended for achieving satisfactory fixing over the whole area of the sheet having the largest width. In an example of FIG. 15, the sheet having the largest width is a paper form of A3 size and the largest width is represented as A3 W. When a sheet (a paper form of B4 size of which width is represented as B4W, in the example of FIG. 15) having a width smaller than the sheet having the largest width is fed, there is produced a part L2 in the first heating width, which does not contribute to heating of the sheet. Then the temperature of the part L2 becomes higher than the temperature of the part L1 that contributes to heating of the sheet, and the temperature of the heating roller varies with respect to width direction of sheet.

As a countermeasure against such temperature increase at ends of the heating roller, there have been proposed heating rollers that contain magnetic cores extending in width direction of sheet and split into three sections and an exciting coil wound in layers around the magnetic cores along inside of the heating roller and that contain demagnetizing coils (canceling coils) wound around the magnetic cores at both ends and extending in direction perpendicular to the layer of the exciting coil, as disclosed in patent literatures (Japanese Patent Laid-Open Publication 2001-60490 and 2001-135470). When a sheet having the largest width is conveyed, the demagnetizing coils are opened by a switching circuit so as not to function. Then satisfactory fixing can be achieved over the whole area of the sheet having the largest width. When a sheet having a width smaller than the largest width is conveyed, the demagnetizing coils are closed by the switching circuit. Then at the ends of the heating roller with respect to the width direction of the sheet, a change of magnetic flux produced by the exciting coil causes not only an induced current (eddy current) in the heating roller but also back electromotive forces (and resultant currents) in the demagnetizing coils. Thus the temperature increase at the ends of the heating roller is prevented.

In such an arrangement in which the demagnetizing coils extend in the direction perpendicular to the layers of the exciting coil as in the patent literatures, however, the exciting coil and most of the demagnetizing coils (portions of the demagnetizing coils other than end portions on the side of the exiting coil) are so apart from each other that leakage flux (magnetic flux that is produced by the exciting coil and that does not contribute to the induced current in the heating roller) misses the demagnetizing coils, and effective function of the demagnetizing coils is thereby prohibited. In addition, there is a problem in that increase in vertical size of the magnetic cores results in enlargement of the device.

SUMMARY OF THE INVENTION

Therefore, an object of the present invention is to provide an induction heating device and an induction heating fixing device which are capable of increasing stability and safety in control of temperature of an object to be heated such as a heating roller by effective function of a demagnetizing coil and which can be configured compactly at low cost.

Another object of the invention is to provide an image forming apparatus having such an induction heating fixing device.

In order to solve the problems, an induction heating device of the invention for inductively heating an object to be heated which is formed of conductive material, comprises:

- a holder which is positioned outside the object;
- an exciting coil for inductively heating the object, wherein the exciting coil is composed of a plurality of turns of conductor forming a layer which is supported by the holder and is positioned along the object; and
- a demagnetizing coil which is positioned along the layer of the exciting coil and in which a back electromotive force is induced in accordance with a magnetic field produced by the exciting coil, so as to cancel the magnetic field.

In the induction heating device of the invention, the layer of conductor that forms the exciting coil is positioned so as to extend along the object. In an operation, a high-frequency current is passed through the exciting coil, and the object is heated by an induced current (eddy current) caused by the current passage. In the induction heating device, the demagnetizing coil is positioned so as to extend along the exciting coil, magnetic flux (including leakage flux) produced by the exciting coil can efficiently be transmitted to the demagnetizing coil, so that a back electromotive force can be produced in the demagnetizing coil. As a result, stability in temperature control for the object can be improved by effective function of the demagnetizing coil. The demagnetizing coil, which is positioned together with the holder outside the object, can be cooled by air satisfactorily. Accordingly, heat capacity (temperature) of the demagnetizing coil itself exerts little influence upon a temperature distribution on the object. Thus stability in the temperature control for the object can further be improved. Wire diameter and winding number of the winding of the demagnetizing coil can be made the smaller because the magnetic flux (including leakage flux) produced by the exciting coil can efficiently be transmitted to the demagnetizing coil. As a result, the induction heating device can be miniaturized and configured at low cost.

The object may contain material other than conductive material.

In an embodiment of the induction heating device, wherein the holder comprises a ferrite core.

In the embodiment of the induction heating device, the magnetic flux produced by the coil is guided to the object through the ferrite core that is magnetic material. Thus heat generating efficiency is improved. As a result, the induction heating device can be configured compactly and miniaturized.

In an embodiment of the induction heating device, the demagnetizing coil is provided between the exciting coil and the holder.

In the embodiment of the induction heating device, the exciting coil, the demagnetizing coil, and the core are positioned, in order of mention, outside the object. That is, the exciting coil exists between the object and the demagnetizing coil, and therefore heat capacity (temperature) of the demagnetizing coil itself exerts little influence upon a temperature distribution on the object. Thus stability in the temperature control for the object can further be improved.

In an embodiment of the induction heating device, the demagnetizing coil is positioned so as to form the same layer as the exciting coil forms.

In the embodiment of the induction heating device, the demagnetizing coil is positioned so as to form the same layer as the exciting coil forms, and an increase in thickness of the coils in direction perpendicular to the layer is therefore avoided. As a result, the induction heating device can further be miniaturized.

In an embodiment, the induction heating device further comprises an insulating layer between the demagnetizing coil and the exciting coil.

Conductor that forms a coil is conventionally coated with insulating material such as enamel, however, the coating may be peeled off resulting from flaws or the like. The induction heating device in accordance with the embodiment therefore has the insulating layer between the demagnetizing coil and the exciting coil. Insulation between the exciting coil and the demagnetizing coil is thereby strengthened for improvement in safety.

Preferably, the demagnetizing coil is a conductive pattern formed on an insulating substrate (such as polyimide film). In such a configuration, thickness of the layer formed by the demagnetizing coil is restrained and insulation between the exciting coil and the demagnetizing coil can easily be ensured.

In an embodiment, the induction heating device further comprises a switching circuit for opening and closing the demagnetizing coil.

Herein, "closing" the demagnetizing coil means configuring a closed circuit including the demagnetizing coil so that a current (induced current) is passed through the demagnetizing coil by a back electromotive force induced in the demagnetizing coil. On the other hand, "opening" the demagnetizing coil means interrupting the closed circuit.

The induction heating device in accordance with the embodiment has the switching circuit for opening and closing the demagnetizing coil and is therefore capable of performing control suitable for heating a sheet by the object and for fixing a toner image to the sheet. When a sheet having the largest width that is fed to the device is conveyed, for example, the demagnetizing coil is opened by the switching circuit so as not to function. Accordingly, satisfactory fixing can be achieved over the whole area of the sheet having the largest width. When a sheet having a width smaller than the largest width is conveyed, the demagnetizing coil is closed by the switching circuit. Then at an end portion of the heating roller with respect to the width direction of the sheet, a change of magnetic flux produced by the exciting coil causes not only an induced current (eddy current) in the heating roller but also a back electromotive force (and a resultant current) in the demagnetizing coil. Thus the eddy current is reduced in the end portion of the heating roller, and temperature increase in the end portion of the heating roller is prevented.

In another aspect, the present invention provides an induction heating fixing device of induction heating type for fixing a toner image to a sheet while conveying the sheet, comprising:

a fixing member formed of conductive material;

a pressurizing member for temporarily pinching the sheet being conveyed, between the pressurizing member and the fixing member, wherein the pressurizing member is provided in pressure contact with the fixing member;

a holder which is positioned outside the fixing member;

an exciting coil for inductively heating the fixing member, wherein the exciting coil is composed of a plurality of turns of conductor forming a layer which is supported by the holder and is positioned along the fixing member; and a demagnetizing coil which is positioned along the layer of the exciting coil and in which a back electromotive force is induced in accordance with a magnetic field produced by the exciting coil, so as to cancel the magnetic field.

In an operation of the induction heating fixing device of the invention, a high-frequency current is passed through the exciting coil, and the fixing member is heated by an induced current (eddy current) caused by the current passage. Then a sheet is conveyed through the pinching part between the fixing member and the pressurizing member, and a toner image formed on the sheet is thereby fixed to the sheet. In the induction heating fixing device in which the demagnetizing coil is positioned so as to extend along the exciting coil, magnetic flux (including leakage flux) produced by the exciting coil can efficiently be transmitted to the demagnetizing coil, so that a back electromotive force can be produced in the demagnetizing coil. As a result, the demagnetizing coil effectively functions to improve stability in control of temperature of the fixing member. Besides, the demagnetizing coil, which is positioned together with the holder outside the fixing member, can be cooled by air satisfactorily. Accordingly, heat capacity (temperature) of the demagnetizing coil itself exerts little influence upon a temperature distribution on the fixing member. Thus stability in the temperature control for the fixing member can further be improved. Wire diameter and winding number of the winding of the demagnetizing coil can be made the smaller because the magnetic flux (including leakage flux) produced by the exciting coil can efficiently be transmitted to the demagnetizing coil. As a result, the induction heating fixing device can be miniaturized and configured at low cost.

The fixing member may contain material other than conductive material.

In an embodiment of the induction heating fixing device, the holder comprises a ferrite core.

In the embodiment of the induction heating fixing device, the magnetic flux produced by the coil is guided to the fixing member through the ferrite core that is magnetic material. Thus heat generating efficiency is improved. As a result, the induction heating fixing device can be configured compactly and miniaturized.

In an embodiment of the induction heating fixing device, the demagnetizing coil is provided between the exciting coil and the holder.

In the embodiment of the induction heating fixing device, induction heating fixing, the exciting coil, the demagnetizing coil, and the core are positioned, in order of mention, outside the fixing member. That is, the exciting coil exists between the fixing member and the demagnetizing coil, and therefore heat capacity (temperature) of the demagnetizing coil itself exerts little influence upon a temperature distribution on the fixing member. Thus stability in the temperature control for the fixing member can further be improved.

In an embodiment of the induction heating fixing device, the demagnetizing coil is positioned so as to form the same layer as the exciting coil forms.

In the embodiment of the induction heating fixing device, the demagnetizing coil is positioned so as to form the same layer as the exciting coil forms, and an increase in thickness of the coils in direction perpendicular to the layer is therefore avoided. As a result, the induction heating fixing device can further be miniaturized.

In an embodiment, the induction heating fixing device further comprises an insulating layer between the demagnetizing coil and the exciting coil.

Conductor that forms a coil is conventionally coated with insulating material such as enamel, however, the coating may be peeled off resulting from flaws or the like. The induction heating fixing device in accordance with the embodiment therefore has the insulating layer between the demagnetizing coil and the exciting coil. Insulation between the exciting coil and the demagnetizing coil is thereby strengthened for improvement in safety.

Preferably, the demagnetizing coil is a conductive pattern formed on an insulating substrate (such as polyimide film). In such a configuration, thickness of the layer formed by the demagnetizing coil is restrained and insulation between the exciting coil and the demagnetizing coil can easily be ensured.

In an embodiment of the induction heating fixing device, the demagnetizing coil is positioned within a narrower region than the exciting coil is, with respect to width direction of the sheet that is conveyed through pinching part between the fixing member and the pressurizing member.

Herein, "width direction of the sheet" refers to a direction substantially perpendicular to a direction in which the sheet is conveyed.

Conventionally, region on the fixing member which region is heated by the exciting coil with respect to the width direction of the sheet is determined in accordance with the sheet having the largest width that is fed to the device. That is intended for achieving satisfactory fixing over the whole area of the sheet having the largest width. In the induction heating fixing device in accordance with the embodiment, as described above, the demagnetizing coil is positioned within the narrower region than the exciting coil is, with respect to the width direction of the sheet. Accordingly, temperature increase at an end of the fixing member is prevented, for example, by provision of the demagnetizing coil only along the end of the fixing member with respect to the width direction of the sheet.

In an embodiment, the induction heating fixing device further comprises a switching circuit for opening and closing the demagnetizing coil.

The induction heating fixing device in accordance with the embodiment has the switching circuit for opening and closing the demagnetizing coil and is therefore capable of performing control suitable for heating a sheet by the fixing member to fix a toner image to the sheet.

In an embodiment of the induction heating fixing device, the switching circuit closes the demagnetizing coil only on occasion of fixing to a sheet of a smaller size than a predetermined size.

In the induction heating fixing device in accordance with the embodiment, the switching circuit closes the demagnetizing coil only on occasion of fixing to a sheet of a smaller size than a predetermined size. When a sheet having the largest width that is fed to the device is conveyed, for example, the demagnetizing coil is opened by the switching circuit so as not to function. Accordingly, satisfactory fixing can be achieved over the whole area of the sheet having the largest width. When a sheet having a width smaller than the largest width is conveyed, the demagnetizing coil is closed by the switching circuit. Then in the region on the fixing member over which the demagnetizing coil is positioned, with respect to the width direction of the sheet, a change of magnetic flux produced by the exciting coil causes not only an induced current (eddy current) in the fixing member but also a back electromotive force (and a resultant current) in the demagnetizing coil. In the configuration in which the demagnetizing coil is provided only along the end of the fixing member, for example, the eddy current is thereby reduced in the end portion of the fixing member, and temperature increase in the end portion of the fixing member is prevented. Thus stability and safety in the temperature control for the fixing member can further be improved.

In another aspect, the present invention provides an image forming apparatus comprising an image forming unit for forming a toner image and an induction heating fixing device of induction heating type for fixing to a sheet the toner image formed by the image forming unit while conveying the sheet, further comprising:

- a fixing member formed of conductive material;
- a pressurizing member for temporarily pinching the sheet being conveyed between the pressurizing member and the fixing member, wherein the pressurizing member is provided in pressure contact with the fixing member;
- a holder positioned outside the fixing member;
- an exciting coil for inductively heating the fixing member, wherein the exciting coil is composed of a plurality of turns of conductor forming a layer which is supported by the holder and is positioned along the fixing member; and
- a demagnetizing coil which is positioned along the layer of the exciting coil and in which a back electromotive force is induced in accordance with a magnetic field produced by the exciting coil, so as to cancel the magnetic field.

The image forming unit may form the toner image directly on the sheet or may form the toner image temporarily on a transferring body and may thereafter transfer the image onto the sheet.

In an operation of the image forming apparatus of the invention, high-frequency current is passed through the coil of the induction heating fixing device, and the fixing member is heated by an induced current (eddy current) caused by the current passage. Then a toner image is formed by the image forming unit, a sheet is conveyed through the pinching part between the fixing member and the pressurizing member, and the toner image formed by the image forming unit is thereby fixed to the sheet. In the image forming apparatus, the demagnetizing coil is positioned so as to extend along the exciting coil, magnetic flux (including leakage flux) produced by the exciting coil can efficiently be transmitted to the demagnetizing coil, so that a back electromotive force can be produced in the demagnetizing coil. As a result, the demagnetizing coil effectively functions to improve stability in control of temperature of the fixing member. Besides, the demagnetizing coil, which is positioned together with the holder outside the fixing member, can be cooled by air satisfactorily. Accordingly, heat capacity (temperature) of the demagnetizing coil itself exerts little influence upon a temperature distribution on the fixing member. Thus stability in the temperature control for the fixing member can further be improved. Wire diameter and winding number of the winding of the demagnetizing coil can be made the smaller because the magnetic flux (including leakage flux) produced by the exciting coil can efficiently be transmitted to the demagnetizing coil. As a result, the induction heating fixing device can be miniaturized and configured at low cost.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
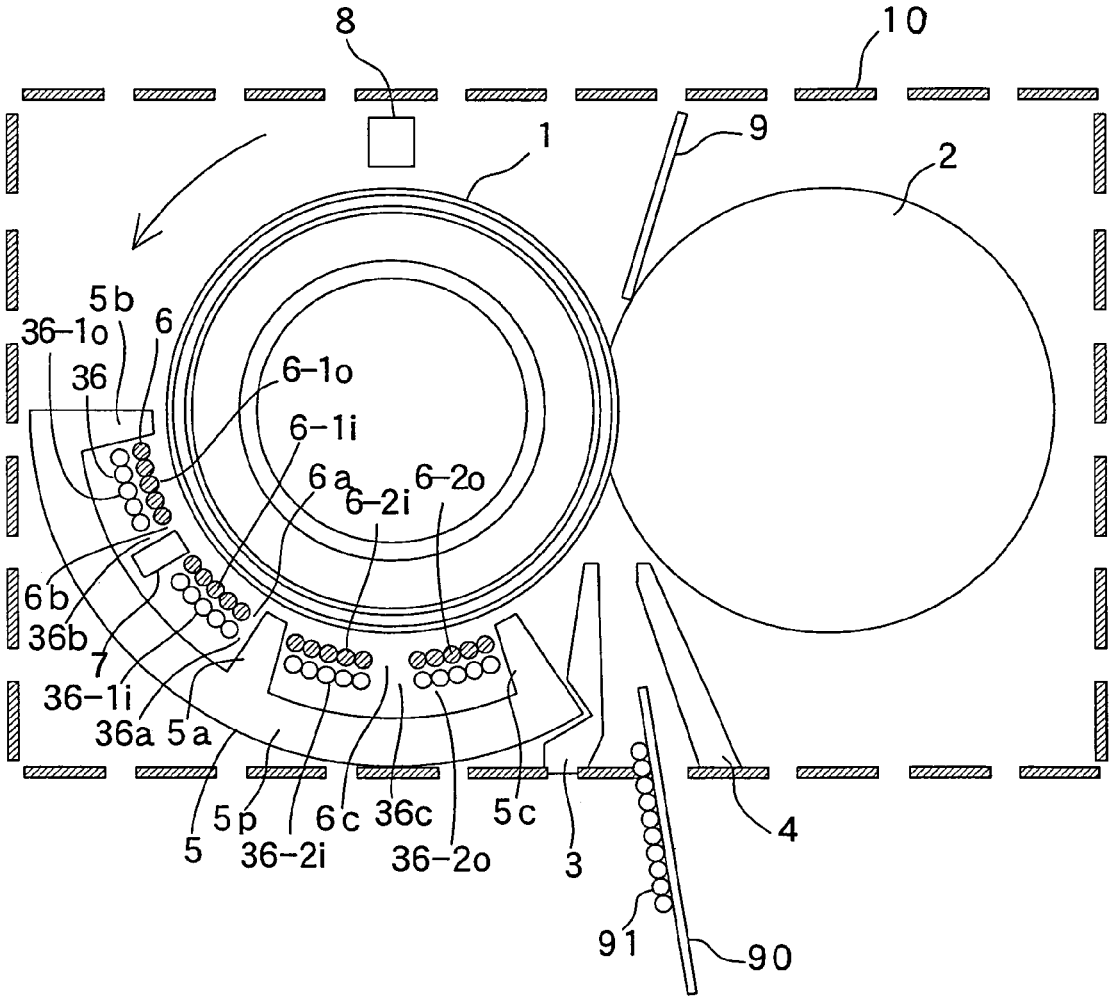
FIG. 1 is a diagram showing a schematic sectional configuration of a fixer for color laser printer as one embodiment of the invention.

Hereinbelow, the present invention will be described in detail with reference to embodiments shown in the drawings.

FIG. 1 shows a sectional configuration of a fixer for color laser printer as one embodiment of an induction heating fixing device having an induction heating device of the invention.

The fixer has in a casing 10 a cylindrical fixing roller 1 as an object to be heated or a fixing member, a cylindrical pressurizing roller 2 as a pressurizing member, a ferrite core 5 as a holder, a layer-like exciting coil 6 that is positioned so as to extend along outer periphery of the fixing roller 1, a layer-like demagnetizing coil 36 that is interposed between the exciting coil 6 and the ferrite core 5, a first temperature sensor 7 composed of a thermostat, a second temperature sensor 8 of infrared type, and guides 3, 4, and 9 for guiding a paper form 90 as a sheet.

Figure 2A:
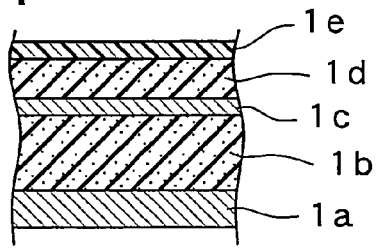
FIG. 2A is a diagram showing a sectional configuration of a part of fixing roller that is a component of the fixer of FIG. 1.
Figure 2B:
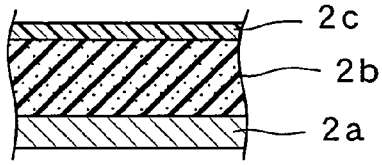
FIG. 2B is a diagram showing a sectional configuration of a part of pressurizing roller that is a component of the fixer of FIG. 1.

As shown in FIG. 2A, the fixing roller 1 is composed of a 1-mm-thick core metal 1*a* made of iron on which a 5-mm-thick Si (silicon) sponge rubber layer 1*b*, a 50-$\mu$m-thick alloy layer 1*c* composed of Ni (nickel) and Cr (chromium), a 1-mm-thick Si rubber layer id, and a 20-$\mu$m-thick surface layer 1*e* composed of PFA (copolymer of tetrafluoroethylene and perfluoroalkyl vinylether) have been provided. As shown in FIG. 2B, the pressurizing roller 2 is composed of a core metal 2*a* made of iron on which a 5-mm-thick Si foam rubber layer 2*b* and a 30-$\mu$m-thick PFA surface layer 2*c* have been provided.

The fixing roller 1 in FIG. 1 is configured so as to be rotated counterclockwise about a central axis thereof by a motor not shown. The pressurizing roller 2 on right side of the fixing roller 1 is biased against the fixing roller 1 by a spring not shown so that a nipping part as a pinching part is formed between the roller 2 and the fixing roller 1 with deformation of the rubber layers. The pressurizing roller 2 is configured so as to be driven by the fixing roller 1. The unfused paper form 90 having toner 91 thereon is conveyed to the nipping part from downside so as to be passed between the guides 3 and 4 and, after a fixing process, the form 90 is guided by the guide 9 so as to be ejected upward.

The ferrite core 5 is composed of magnetic material and is positioned outside and below the fixing roller 1 so as to extend along and face the outer periphery of the fixing roller 1. The ferrite core 5 has a cross section generally shaped like a letter E as a whole and extends along axial direction of the fixing roller 1. Specifically, the ferrite core 5 has a main body 5*p* having a cross section shaped like a circular arc with the same curvature that the outer periphery of the fixing roller 1 has, and three protrusions extending from the main body 5*p* toward the fixing roller 1, i.e., a center protrusion 5*a* and end protrusions 5*b* and 5*c*.

Figure 3:
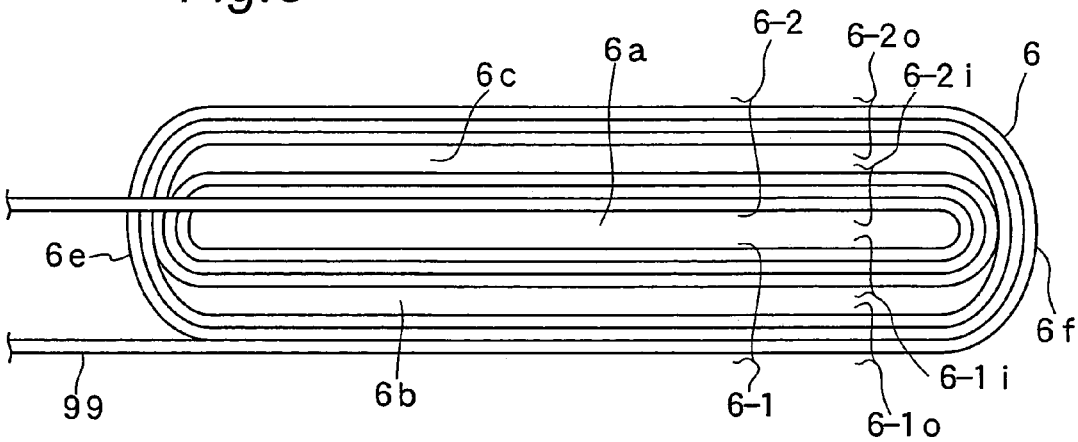
FIG. 3 is a diagram showing a plane layout of an exciting coil that is a component of the fixer of FIG. 1.

As shown in FIG. 3, the exciting coil 6 is formed of a plurality of turns of conductor 99 shaped like ellipses in a plane layout in general view. A piece of conductor 99 is made of a publicly-known strand with a diameter on the order of several millimeters that has been formed of a bunch of about one hundred and tens of pieces of wire (copper wire having a diameter on the order of 0.18 to 0.20 mm and having insulating enamel coating) for increase in current-carrying efficiency.

Specifically, the exciting coil 6 includes an outward conductor section 6-1 and a return conductor section 6-2 both of which extend in longitudinal direction (in lateral direction in FIG. 3) and circular-arc curved conductor sections 6*f* and 6*e* which link the conductor sections to each other. Between the outward conductor section 6-1 and the return conductor section 6-2 exists a center gap 6*a* on the order of several millimeters. The exciting coil 6 is wound tight, basically, but a gap 6*b* on the order of several millimeters is provided between an outer conductor section 6-1*o* and an inner conductor section 6-1*i* in the outward conductor section 6-1 through which electric currents respectively flow in the same direction. In the same manner as the gap 6*b*, a gap 6*c* on the order of several millimeters is provided between an outer conductor section 6-2*o* and an inner conductor section 6-2*i* in the return conductor section 6-2 through which electric currents respectively flow in the same direction. In this example, the gaps 6*b* and 6*c* as well as the center gap 6*a* extend uniformly in the longitudinal direction from the curved conductor section 6*f* to the curved conductor section 6*e* at both ends thereof.

The longitudinal direction of the exciting coil 6 correspond to a direction parallel to the central axis of the fixing roller 1 in FIG. 1, in other words, corresponds to width direction of the paper form 90 that are substantially perpendicular to the direction in which the paper form 90 is conveyed in the nipping part. A size of the fixing roller 1 in the axial direction and a size of the exciting coil 6 in the longitudinal direction are set at values of 297 mm plus small margins so that a paper form having the largest width that is fed to the device (a paper form of "A3 size" defined by the Japanese Industrial Standards, in this example) can be dealt with.

Figure 4A:
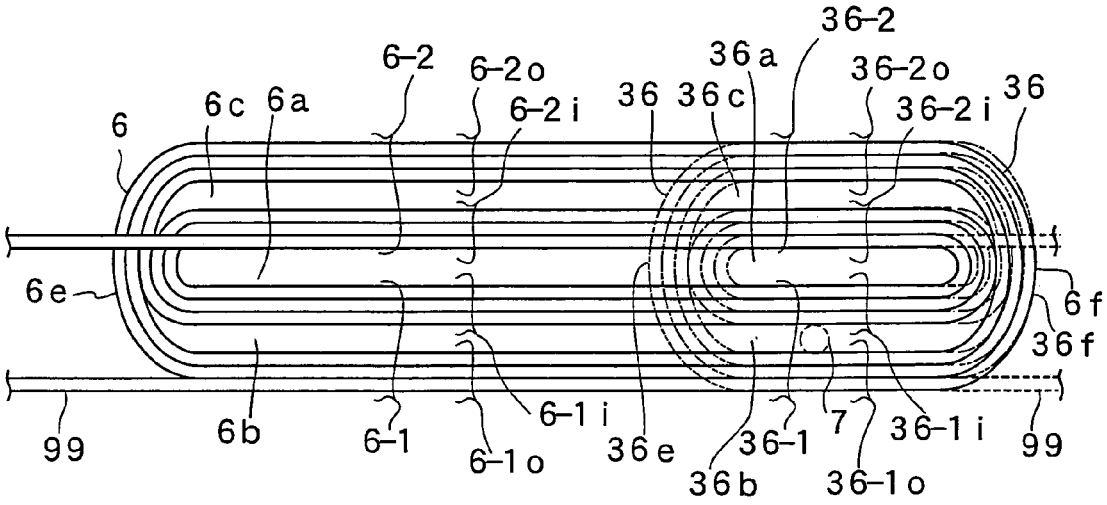
FIG. 4A is a diagram showing the exciting coil of FIG. 3 on which a demagnetizing coil has been overlaid.
Figure 4B:
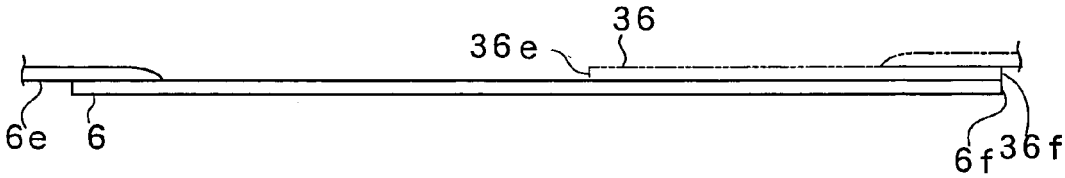
FIG. 4B is a view of the exciting coil and the demagnetizing coil from lower side in FIG. 4A.

FIG. 4A shows a plane layout of the exciting coil 6 on which the demagnetizing coil 36 has been overlaid. FIG. 4B shows a view of the coils 6 and 36 from lower side in FIG. 4A.

As is apparent from FIG. 4A, the demagnetizing coil 36 is formed of a plurality of turns of conductor 99 that is shaped like ellipses and that is the same as the conductor forming the exciting coil 6.

A longitudinal size of the demagnetizing coil 36 (a size between the section 36*e* and the section 36*f*) is set smaller than the longitudinal size of the exciting coil 6 (the size between the section 6*e* and the section 6*f*). As described above, the longitudinal size of the exciting coil 6 is set at a value of a small margin plus the width of the paper form having the largest width that is fed to the device (a width A4W (=297 mm) of the paper form of A3 size defined by the Japanese Industrial Standards, in this example). The longitudinal size of the demagnetizing coil 36 is set at a value provided by subtracting a width B4W (=257 mm) of a paper form of B4 size, for example, from the longitudinal size of the exciting coil 6.

A configuration of the demagnetizing coil 36 except the longitudinal size is the same as the configuration of the exciting coil 6. That is, the demagnetizing coil 36 has a center gap 36*a* and gaps 36*b* and 36*c* positioned symmetrically about the center gap 36*a*, corresponding to the gaps 6*a*, 6*b*, and 6*c* of the exciting coil 6. The gap 36*b* is provided between an outer conductor section 36-1*o* and an inner conductor section 36-1*i* in an outward conductor section 36-1 through which electric currents respectively flow in the same direction. The gap 36*c* is provided between an outer conductor section 36-2*o* and an inner conductor section 36-2*i* in a return conductor section 36-2 through which electric currents respectively flow in the same direction.

As shown in FIG. 1, the exciting coil 6 and the demagnetizing coil 36 are mounted on the ferrite core 5 with adhesive such as glue in such a manner that the center gaps 6*a*, 36*a* of the coils are fit on the center protrusion 5*a* of the ferrite core 5 and that the exciting coil 6 and the demagnetizing coil 36 as a whole are surrounded and enclosed by the end protrusions 5*b* and 5*c* of the ferrite core 5. After the mounting on the ferrite core 5, the layers formed by the exciting coil 6 and the demagnetizing coil 36 have the same curvature as that of the outer periphery of the fixing roller 1, so as to extend along the outer periphery of the fixing roller 1. At a position in the center protrusion 5*a* of the ferrite core 5 that corresponds to the curved section 36*e* of the demagnetizing coil 36 is provided a cutout not shown, which prevents the center protrusion 5*a* from interfering with the curved section 36*e* of the demagnetizing coil 36.

The first temperature sensor 7 composed of a thermostat is positioned so as to extend through the gap 6*b* of the exciting coil 6 and through the gap 36*b* of the demagnetizing coil 36 and so as to face the fixing roller 1 (the position of the first temperature sensor 7 on the plane layout is shown by a broken line in FIG. 4A).

The ferrite core 5, the exciting coil 6, the demagnetizing coil 36, and the first temperature sensor 7 form a coil unit for induction heating as the induction heating device.

Upon passage of a current through the exciting coil 6 in such an arrangement, most of a magnetic field produced by the exciting coil 6 is guided by the ferrite core 5 to pass through the Ni alloy layer 1*c* of the fixing roller 1, eddy currents are produced there, and heat is generated in a region of the outer periphery of the fixing roller 1 that faces the exciting coil 6. Thus most of the magnetic field produced by the exciting coil 6 is guided to the fixing roller 1 through the ferrite core 5 that is magnetic material, and therefore heat generating efficiency is increased. As a result, this fixer can be made compact and can be miniaturized.

Angle positions of the gaps 6*b* and 6*c* of the exciting coil 6 (and the gaps 36*b* and 36*c* of the demagnetizing coil 36) are made to correspond to positions of peaks in a distribution of generated heat. That is, the thermostat 7 provided in the gap 6*b* is thus capable of detecting a temperature of a peak of the distribution of generated heat. In the distribution of generated heat which is symmetrical on both sides of the center protrusion 5*a* of the ferrite core 5, a temperature of a part corresponding to the gap 6*c* on the downstream side can be found by the provision of the temperature sensor in the gap 6*b* on the upstream side, as shown in this example, and by the detection of the temperature of the part corresponding to the gap 6*b*.

As shown in FIG. 1, on the other hand, the second temperature sensor 8 faces a part of the outer periphery of the fixing roller 1 that is far from the heating region. Accordingly, the second temperature sensor 8 detects an averaged temperature that has been relaxed by heat transfer, when a heating region of the fixing roller 1 at a certain time comes to the position facing the sensor 8 while rotating.

Figure 5A:
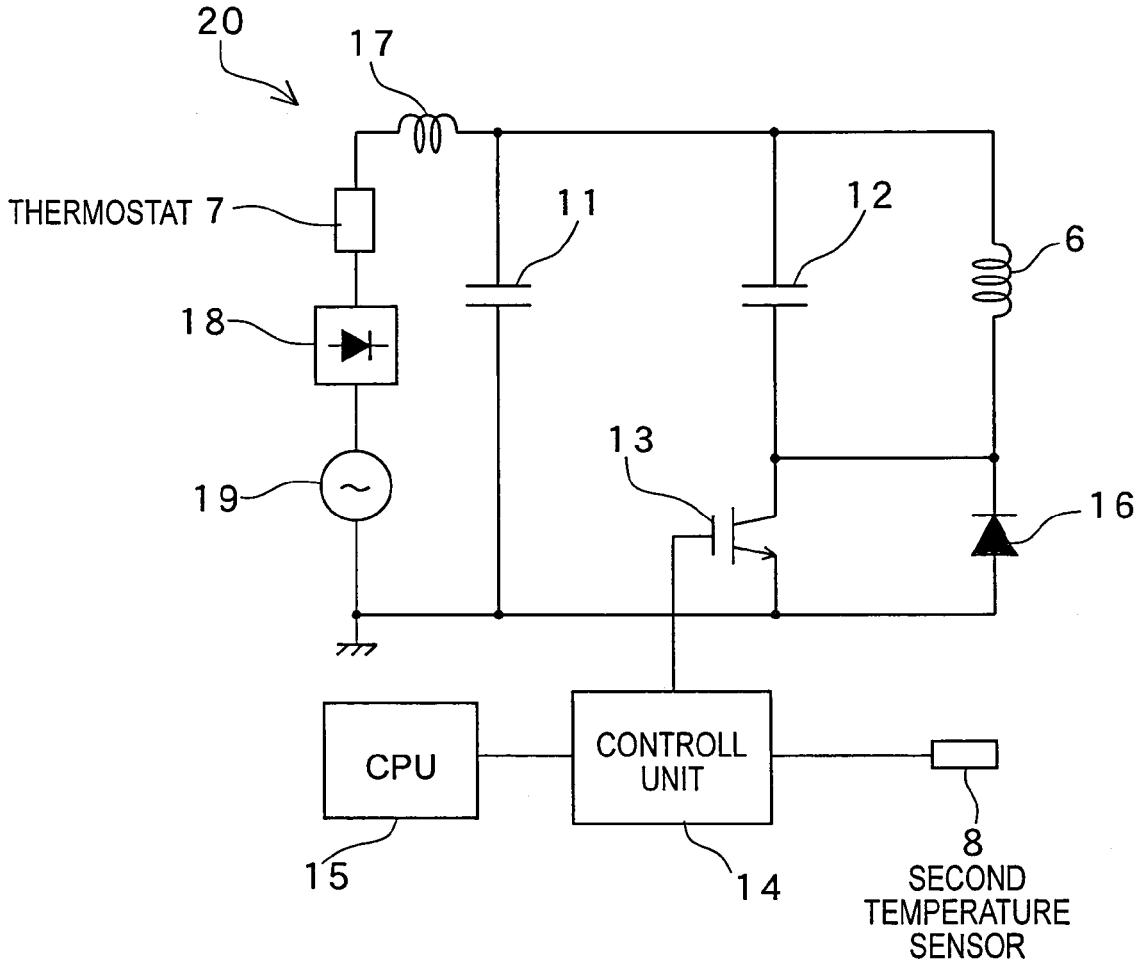
FIG. 5A is a diagram showing a configuration of a temperature controlling circuit for the fixer.

FIG. 5A shows a configuration of a temperature controlling circuit 20 for passing a current through the exciting coil 6 while controlling the temperature of the fixing roller 1. The temperature controlling circuit 20 has an AC (alternating current) power supply 19, a diode 18 for rectification, a thermostat (a switch unit thereof) 7 inserted in series with respect to the AC power supply 19, a smoothing coil 17 and a smoothing capacitor 11, a main capacitor 12 that forms a single LC oscillator circuit in combination with the exciting coil 6, an IGBT (Insulated Gate Bipolar Transistor) 13 for turning on and off the LC oscillator circuit, a diode 16 for extinguishing residual electric charge when the circuit shifts to off state, and a control unit 14 for turning on and off the IGBT 13.

Figure 5B:
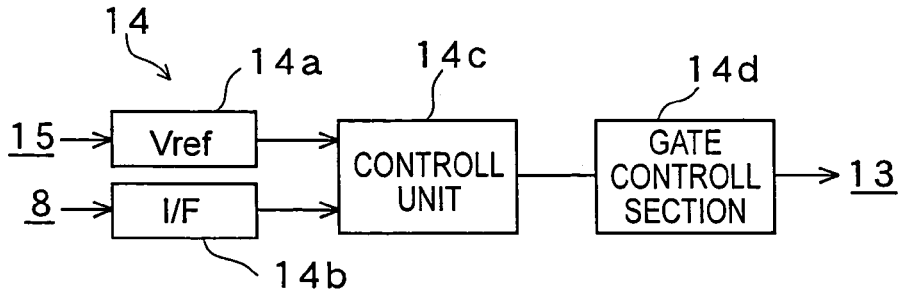
FIG. 5B is a diagram showing a configuration of a control unit that is a component of the temperature controlling circuit.

On basis of signal representing an operation mode from a CPU (Central Processing Unit) 15 for performing control over a whole printer (signal on a target temperature of the fixing roller 1 in printing mode, standby mode or the like) and signal representing a detected temperature from the second temperature sensor 8, the control unit 14 performs ON/OFF control over the IGBT 13 so as to approach the detected temperature to the target temperature. As shown in FIG. 5B, specifically, the control unit 14 is composed of a reference voltage producing section 14*a* for producing a reference voltage Vref corresponding to an operation mode (a target temperature), an interface (I/F) section 14*b* for converting an output of the second temperature sensor 8 into a voltage that can be compared with the reference voltage Vref, a comparing section 14*c* for detecting a difference between the reference voltage Vref from the reference voltage producing section 14*a* and the voltage from the interface section 14*b*, and a gate control section 14*d* for controlling a gate voltage of the IGBT 13 in accordance with the difference.

Figure 5C:
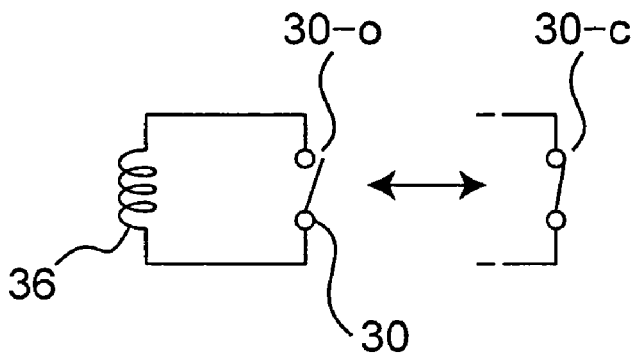
FIG. 5C is a diagram showing a switching circuit for switching the demagnetizing coil.

FIG. 5C shows a configuration of a switching circuit for switching the demagnetizing coil 36. The switching circuit is composed of a change-over switch 30 connected to both ends of conductor that forms the demagnetizing coil 36. Reference characters 30-*o* denote a state in which the change-over switch 30 is "open" (OFF) and reference characters 30-*c* denote a state in which the change-over switch 30 is "closed" (ON).

Figure 6:
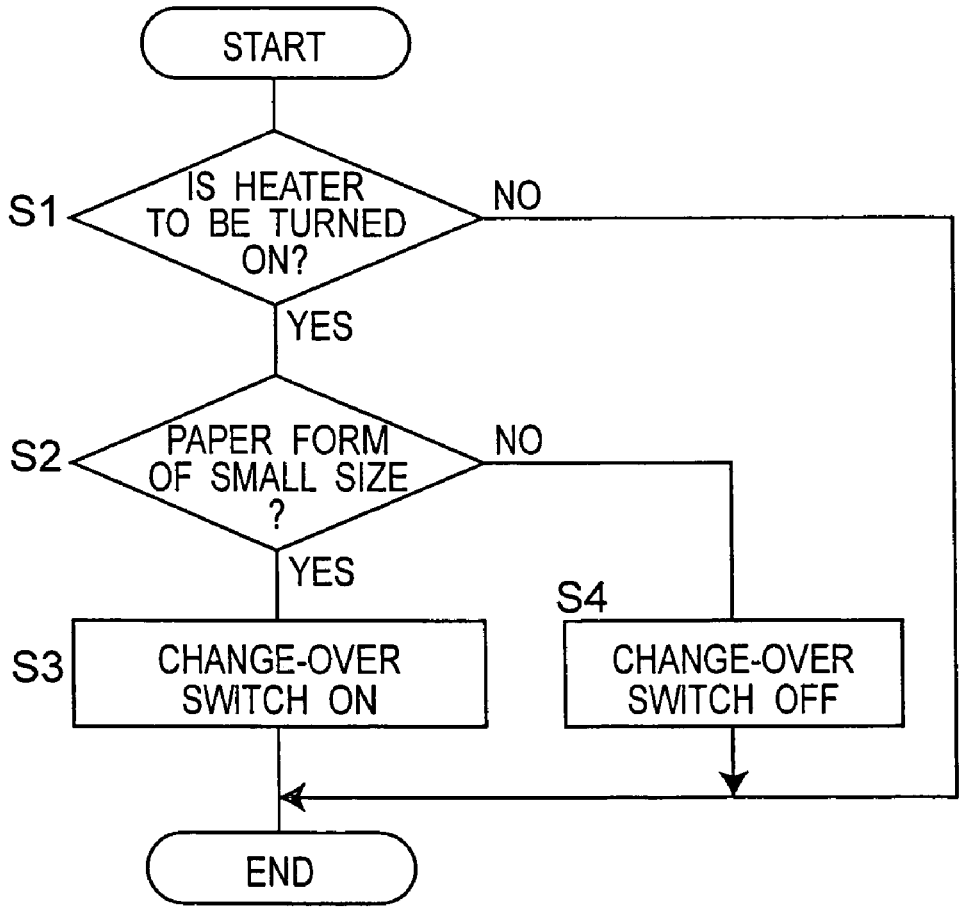
FIG. 6 is a diagram showing a flow for switching the demagnetizing coil.

The change-over switch 30 is subjected to ON/OFF control by the CPU 15 in accordance with a flow chart shown in FIG. 6. That is, the CPU 15 judges whether or not to activate the fixer (turn the heater on) on basis of an operation mode of the printer (S1). Provided that the fixer is to be activated (YES in S1), judged is whether the size of paper form 90 to be conveyed is A3 size with the largest width or smaller size such as B4 size (S2). If the paper form is of A3 size with the largest width, the change-over switch 30 is turned off (S4). If the paper form is of smaller B4 size, the change-over switch 30 is turned on (S3).

In a printing operation, the temperature controlling circuit 20 including the control unit 14 passes electric current through the exciting coil 6 and controls the temperature of the fixing roller 1 to a target temperature according to a printing mode. Then the paper form 90 is conveyed through the nipping part between the fixing roller 1 and the pressurizing roller 2, and a toner image 91 formed on the paper form 90 is thereby fixed to the paper form 90.

If the paper form 90 that is conveyed then is of A3 size with the largest width, the change-over switch 30 is turned off in accordance with the flow of FIG. 6. Thus the demagnetizing coil 36 is opened so as not to function. Accordingly, satisfactory fixing can be achieved over the whole area of the sheet having the largest width.

If the paper form 90 that is conveyed then is of B4 size, for example, smaller than A3 size, the change-over switch 30 is turned on in accordance with the flow of FIG. 6. Thus the demagnetizing coil 36 is closed. Then at an end portion of the fixing roller 1 with respect to the width direction of the paper form 90 (in a region where the demagnetizing coil 36 exists), a change of magnetic flux produced by the exciting coil 6 causes not only an induced current (eddy current) in the fixing roller 1 but also a back electromotive force (and a resultant current) in the demagnetizing coil 6. Thus the eddy current in the fixing roller 1 is reduced and temperature increase in the end portion of the fixing roller 1 is thereby prevented. As a result, stability and safety in the temperature control for the fixing roller 1 can be improved.

In the fixer, besides, the exciting coil 6 exists between the fixing roller 1 and the demagnetizing coil 36, and therefore heat capacity (temperature) of the demagnetizing coil 36 itself exerts little influence upon a temperature distribution on the fixing roller 1. Thus safety in the temperature control for the fixing roller 1 can further be improved.

On condition that the rotation of the fixing roller 1 is stopped or retarded by failure in the motor or the like, the heating region of the fixing roller 1 may extraordinarily rise in temperature. In the fixer, the thermostat 7 as the first temperature sensor provided in the gap 6*b* of the coil described above detects the temperature of the peak of the distribution of generated heat. Therefore, the peak temperature of the distribution of generated heat can be detected accurately. If the peak temperature of the distribution of generated heat exceeds a temperature specified in a predetermined safety standard, the thermostat 7 is turned off and the passage of the current through the exciting coil 6 is thereby interrupted. As a result, stability and safety in the temperature control for the fixing roller 1 can be improved.

The gaps 6*b* and 6*c* are provided between the conductor sections that form the exciting coil 6, so that the exciting coil 6 is cooled by passage of air through the gaps 6*b* and 6*c*. Accordingly, copper loss is restrained from increasing and the heat generating efficiency can be kept high.

The thermostat 7 may be provided in another position, for example, in the center gap 6*a* of the exciting coil 6.

In the above example, the switch 30 is turned on and off by the CPU 15 and the demagnetizing coil is thereby closed and opened. The switch 30, however, may manually be operated.

Figure 8:
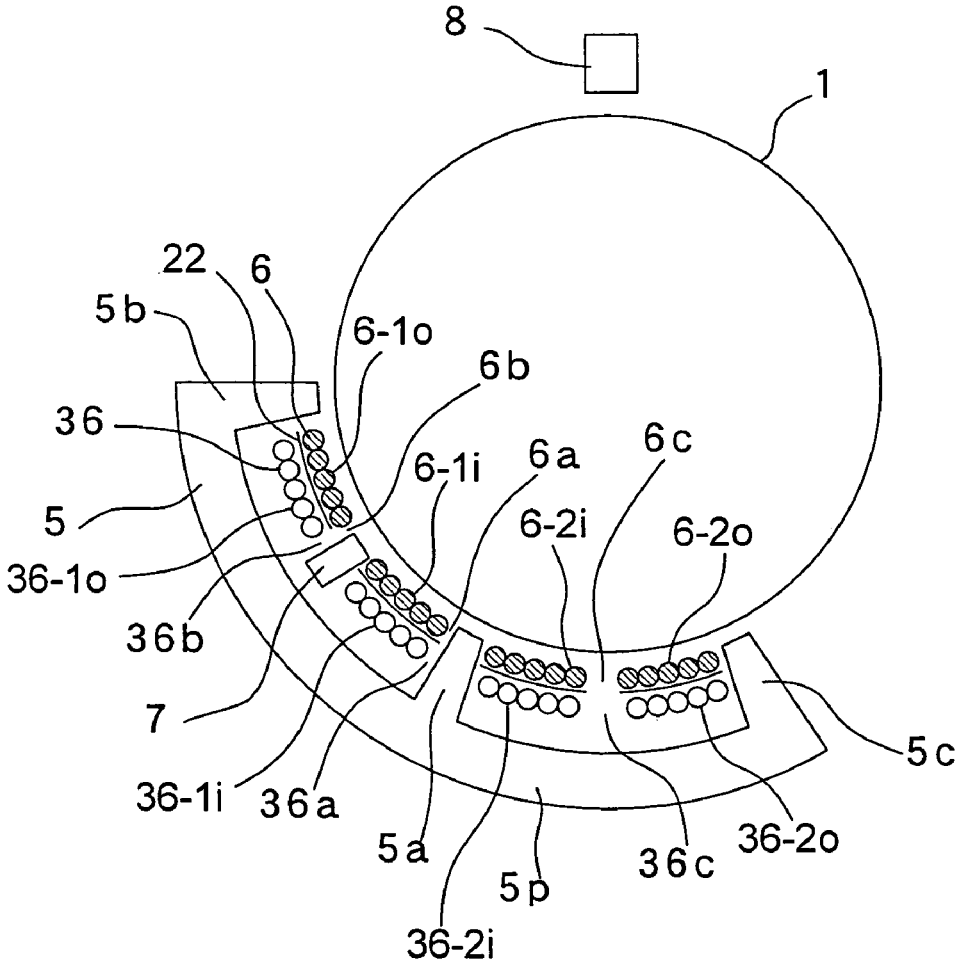
FIG. 8 is a diagram illustrating a fixer of another embodiment of the invention.

An insulating layer 22 may be provided between the demagnetizing coil 36 and the exciting coil 6, as shown in FIG. 8. Insulation between the exciting coil 6 and the demagnetizing coil 36 is thereby strengthened for improvement in safety.

Figure 7:
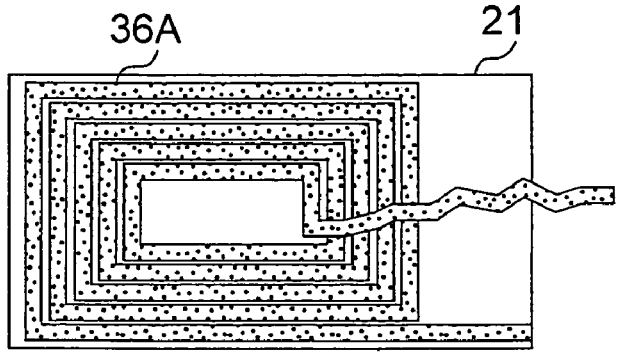
FIG. 7 is a diagram showing a sheet coil.

As shown in FIG. 7, a sheet coil 36A may be provided in place of the demagnetizing coil 36 in FIG. 1. The sheet coil 36A is composed of a conducting film patterned on an insulating substrate (such as polyimide film) 21. This example is equivalent to the demagnetizing coil 36 and the insulating layer 22 in FIG. 8 that have been integrated. The provision of the sheet coil 36A restrains thickness of the layer formed by the demagnetizing coil and ensures insulation between the exciting coil 6 and the demagnetizing coil. Handling of the coil is facilitated by adopting the sheet coil 36A. Besides, reduction in cost and miniaturization of the coil can be achieved and thus the fixer can be configured compactly at low cost.

Figure 9:
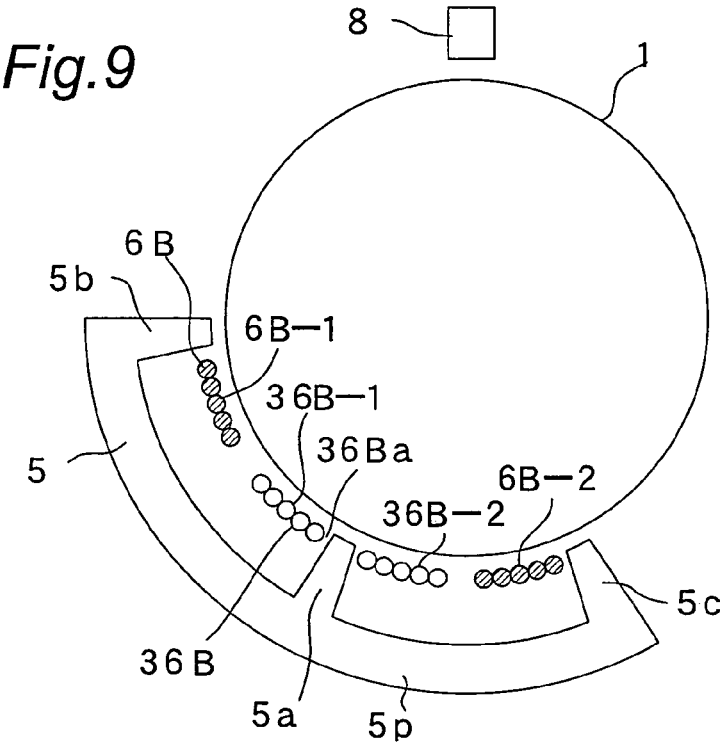
FIG. 9 is a diagram illustrating a fixer of still another embodiment of the invention.
Figure 10A:
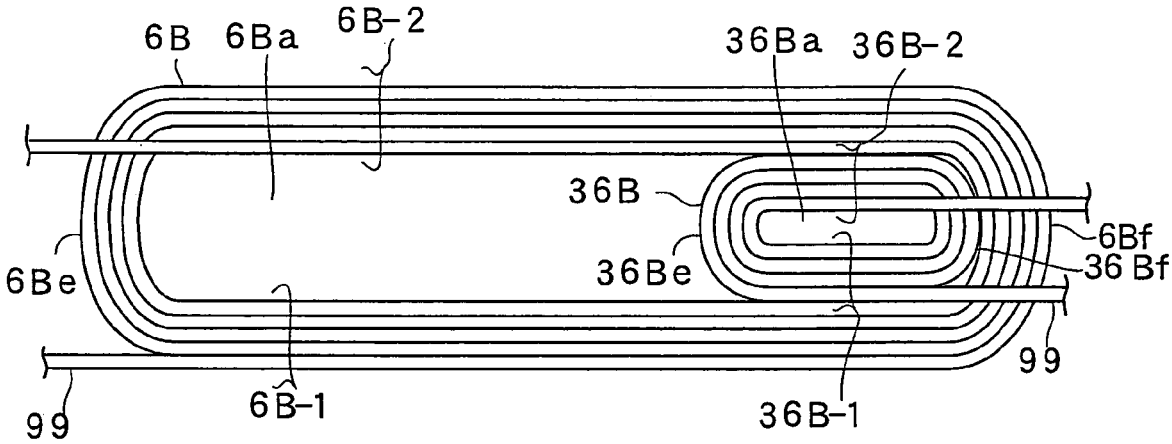
FIG. 10A is a diagram showing a plane layout of an exciting coil and a demagnetizing coil that are used in the fixer of FIG. 9.
Figure 10B:
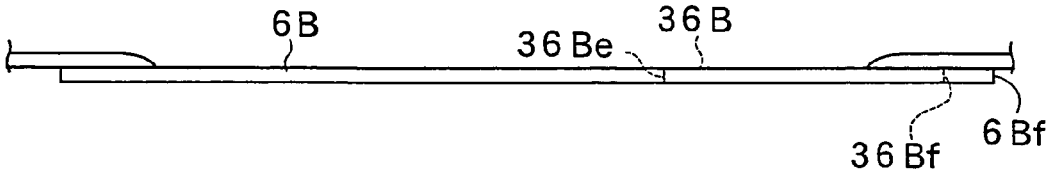
FIG. 10B is a view of the exciting coil and the demagnetizing coil from lower side in FIG. 10A.

In place of the exciting coil 6 and the demagnetizing coil 36 in FIG. 1, an exciting coil 6B and a demagnetizing coil 36B may be provided so as to form the same layer, as shown in FIG. 9. FIG. 10A shows a plane layout of the exciting coil 6B and the demagnetizing coil 36B in this example. FIG. 10B shows a view of the coils 6B and 36B from lower side in FIG. 10A.

Specifically, the exciting coil 6B includes an outward conductor section 6B-1 and a return conductor section 6B-2 both of which extend in longitudinal direction (in lateral direction in FIG. 10A) and circular-arc curved conductor sections 6Bf and 6Be which link the conductor sections to each other. A center gap 6Ba exists between the outward conductor section 6B-1 and the return conductor section 6B-2. Similarly, the demagnetizing coil 36B includes an outward conductor section 36B-1 and a return conductor section 36B-2 both of which extend in longitudinal direction (in the lateral direction in FIG. 10A) and circular-arc curved conductor sections 36Bf and 36Be which link the conductor sections to each other. A center gap 36Ba exists between the outward conductor section 36B-1 and the return conductor section 36B-2. The demagnetizing coil 36B is provided in the center gap 6Ba of the exciting coil 6B so as to extend along inner periphery of the curved section 6Bf. Both the exciting coil 6B and the demagnetizing coil 36B are wound tight.

The exciting coil 6B and the demagnetizing coil 36B that are provided so as to form the same layer in this manner causes no increase in thickness of the coils in direction perpendicular to the layer. Thus the fixer can be miniaturized further.

Figure 11:
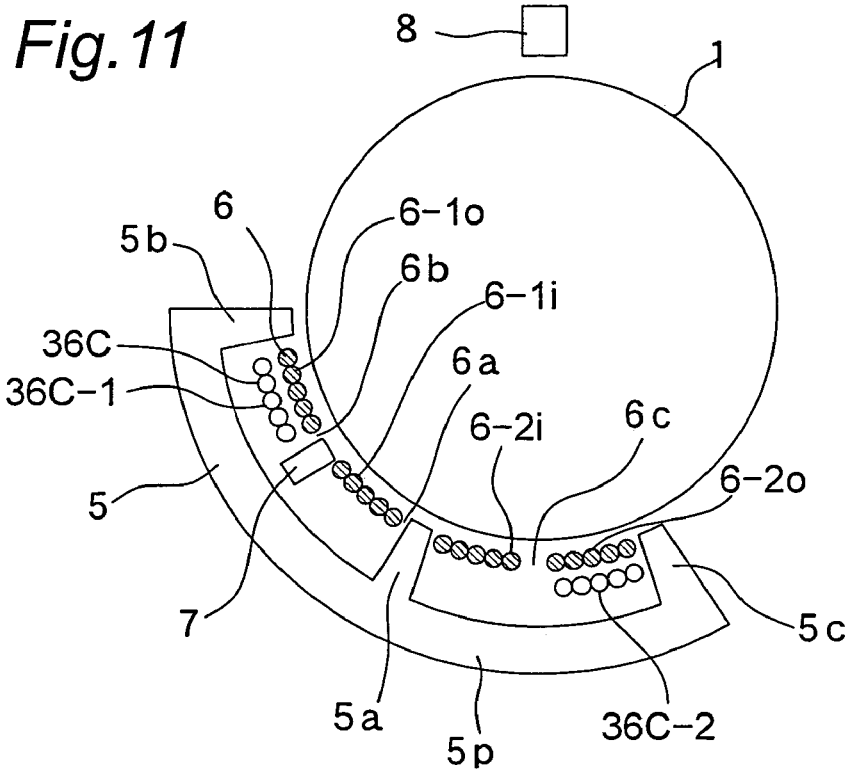
FIG. 11 is a diagram illustrating a fixer of still another embodiment of the invention.

As shown in FIG. 11, a demagnetizing coil 36C which has a winding number smaller than the exciting coil 6 has may be provided in place of the demagnetizing coil 36 in FIG. 1. The winding number of the demagnetizing coil 36C can be set at an optimum value according to a demagnetizing effect. In this example, the demagnetizing coil 36C is composed of an outward conductor section 36C-1 and a return conductor section 36C-2 which correspond to the outer conductor sections 6-1*o* and 6-2*o* of the exciting coil 6, respectively.

Figure 12:
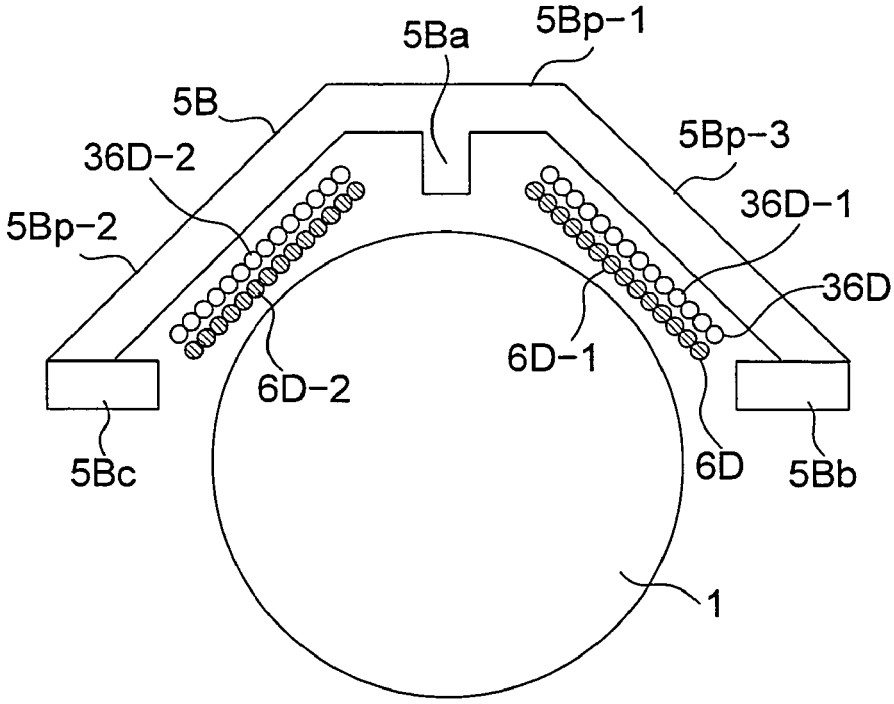
FIG. 12 is a diagram illustrating a fixer of still another embodiment of the invention.

As shown in FIG. 12, a ferrite core 5A, an exciting coil 6D, and a demagnetizing coil 36D which differ in cross section from the ferrite core 5, the exciting coil 6, and the demagnetizing coil 36 of FIG. 1 may be provided in place of those.

Specifically, the ferrite core 5B has a flat top 5Bp-1 which faces the fixing roller 1, wings 5Bp-2, 5Bp-3 which are provided on both sides of the top 5Bp-1, extending aslant so as to open, and which face the fixing roller 1, and three protrusions 5Ba, 5Bb and 5Bc which extend toward the fixing roller 1 from a center of the top 5Bp-1 and from ends of the wings 5Bp-2, 5 Bp-3, respectively.

The exciting coil 6D is composed of a layer-like outward conductor section 6D-1 and a layer-like return conductor section 6D-2 which are positioned in parallel with the wings 5Bp-3 and 5Bp-2 of the ferrite core 5B, respectively.

Similarly, the demagnetizing coil 36D is composed of a layer-like outward conductor section 36D-1 and a layer-like return conductor section 36D-2 which are positioned between and in parallel with the wings 5Bp-3, 5 Bp-2 of the ferrite core 5B and the outward conductor section 6D-1, the return conductor section 6D-2 of the exciting coil 6D, respectively.

Thus the exciting coil 6D and the demagnetizing coil 36D have only to be positioned generally along the fixing roller 1, and do not have to have the same curvature that the outer periphery of the fixing roller 1 has.

Figure 13:
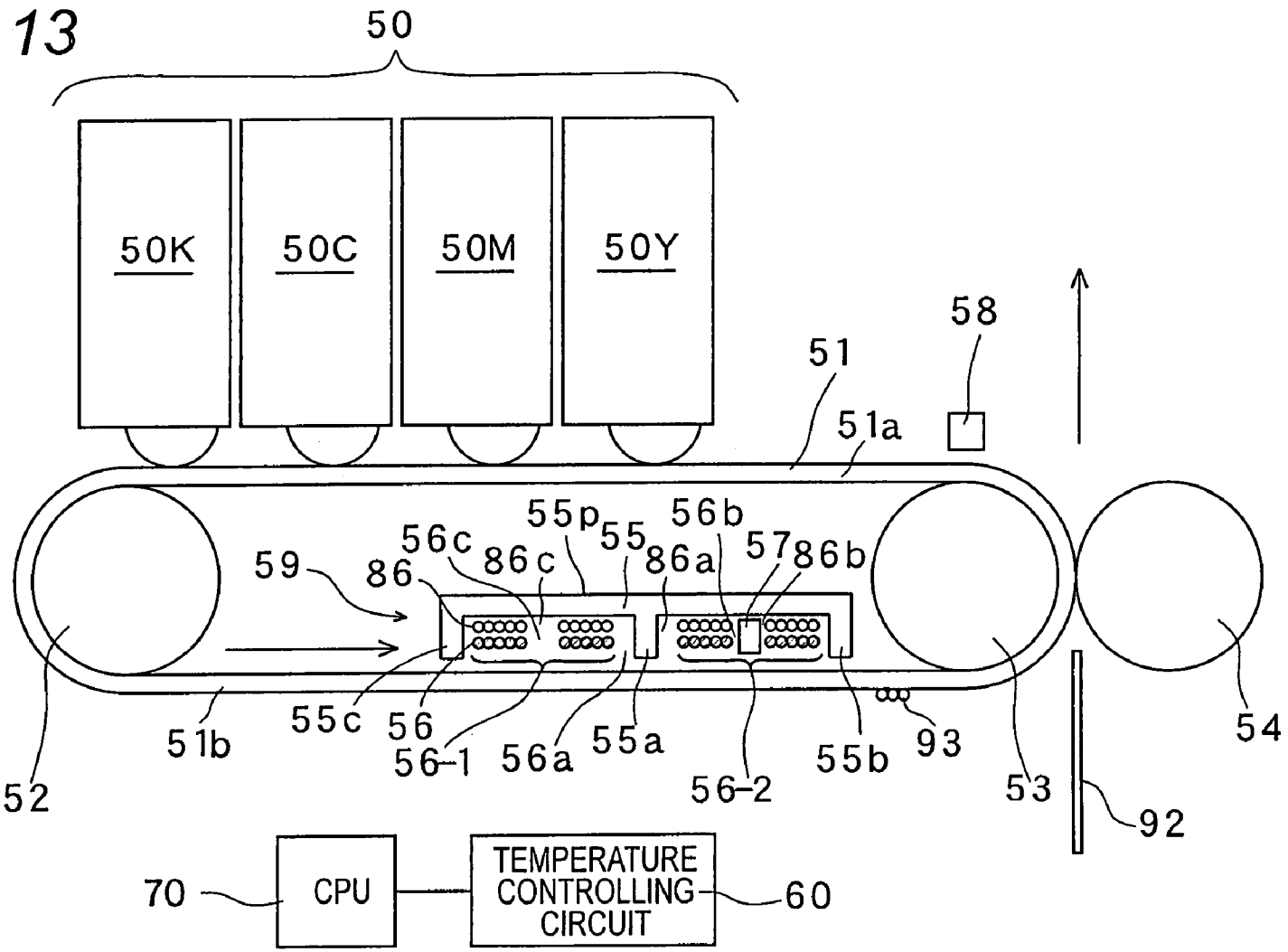
FIG. 13 is a diagram showing a schematic sectional configuration of a color printer as one embodiment of the invention.

FIG. 13 shows a configuration of a color printer as an embodiment of an image forming apparatus of the invention.

The color printer has a four-color developing unit 50 as a image forming unit, loop-like transfer felt 51 as an object to be heated or a fixing member wound around a roller 52 and a fixing roller 53, a cylindrical pressurizing roller 54 as a pressurizing member, a coil unit 59 for induction heating that is positioned so as to extend along a flat section (a lower side section 51*b*) inside the transfer felt 51, a second temperature sensor 58, and guides (not shown) for guiding a paper form 92 as a sheet.

The developing unit 50 has a yellow developing section 50Y, a magenta developing section 50M, a cyan developing section 50C, and a black developing section 50K, which are disposed along a direction of circulation of the transfer felt 51. A toner image 93 with four colors is transferred onto the transfer felt 51 by the developing sections.

The transfer felt 51 is configured like a belt wound around the roller 52 and the fixing roller 53. In the transfer felt 51, for convenience, an upper section between the roller 52 and the fixing roller 53 is referred to as an upper side section 51*a*, and a lower section between the roller 52 and the fixing roller 53 is referred to as the lower side section 51*b*. The transfer felt 51 is driven by the roller 52 and the fixing roller 53 so as to circulate in the direction such that the upper side section 51*a* moves leftward and such that the lower side section 51*b* moves rightward, as shown by an arrow in FIG. 13.

Figure 14:
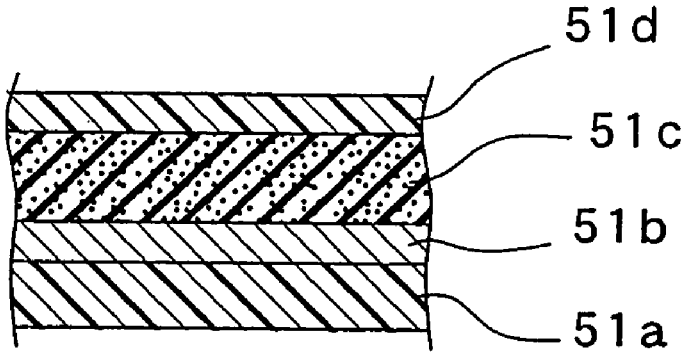
FIG. 14 is a diagram showing a sectional configuration of a part of transfer felt that is a component of the printer of FIG. 13.
Figure 15:
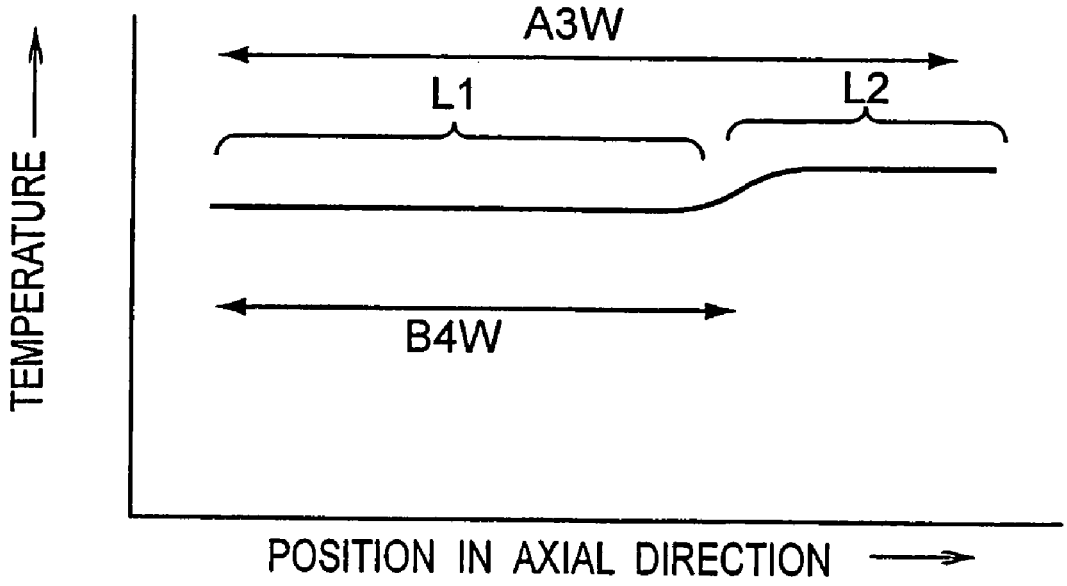
FIG. 15 is a diagram showing a temperature distribution on a heating roller with respect to axial direction thereof in a conventional fixing device of induction heating type.

As shown in FIG. 14, the transfer felt 51 is composed of a 130-μm-thick PI (polyimide) layer 50*a*, a 20-μm-thick Ni layer 50*b*, a 150-μm-thick Si rubber layer 50*c*, and a 20-μm-thick PFA layer 50*d*. The fixing roller 53, in which a foam Si rubber layer is provided on an iron core metal, is opposed to the pressurizing roller 54 having a configuration similar to that of the fixing roller 53, with the transfer felt 51 between.

In FIG. 13, the pressurizing roller 54 is biased against the fixing roller 53 by a spring not shown, so that a nipping part as a pinching part is formed between the roller 54 and the transfer felt 51 with deformation of the rubber layers. The pressurizing roller 54 is configured so as to be driven by the transfer felt 51. A paper form 92 is conveyed to the nipping part from downside and, after a fixing process, the form 92 is ejected upward.

The coil unit 59 for induction heating has a ferrite core 55 as a holder, a layer-like exciting coil 56 positioned along the flat section (the lower side section 51*b*) inside the transfer felt 51, a layer-like demagnetizing coil 86 interposed between the exciting coil 56 and the ferrite core 55, and a first temperature sensor 57 composed of a thermostat.

The ferrite core 55 has a cross section generally shaped like a letter E as a whole, and extends along axial direction of the fixing roller 53. Specifically, the ferrite core 55 has a main body 55*p* having a cross section shaped like a flat plate and three protrusions extending from the main body 55*p* toward the transfer felt 51, i.e., a center protrusion 55*a* and end protrusions 55*b* and 55*c*.

The configuration of the exciting coil 56 is the same as the configuration of the exciting coil 6 shown in FIG. 3. That is, a center gap 56*a* exists between an outward conductor section 56-1 and a return conductor section 56-2. The exciting coil 56 is wound tight, basically, but a gap 56*b* is provided between an outer conductor section and an inner conductor section in the outward conductor section 56-1 through which electric currents respectively flow in the same direction. A gap 56*c* on the same order as the gap 56*b* is provided between an outer conductor section and an inner conductor section in the return conductor section 56-2 through which electric currents respectively flow in the same direction.

Similarly, the configuration of the demagnetizing coil 86 is the same as the configuration of the demagnetizing coil 36 shown in FIG. 4. That is, a center gap 86*a* exists between an outward conductor section 86-1 and a return conductor section 86-2. The demagnetizing coil 86 is wound tight, basically, but a gap 86*b* is provided between an outer conductor section and an inner conductor section in the outward conductor section 86-1 through which electric currents respectively flow in the same direction. A gap 86*c* on the same order as the gap 86*b* is provided between an outer conductor section and an inner conductor section in the return conductor section 86-2 through which electric currents respectively flow in the same direction.

The exciting coil 56 and the demagnetizing coil 86 are mounted on the ferrite core 55 with adhesive such as glue in such a manner that the center gaps 56*a*, 86*a* of the coils are fit on the center protrusion 55*a* of the ferrite core 55 and that the exciting coil 56 and the demagnetizing coil 86 as a whole are surrounded and enclosed by the end protrusions 55*b* and 55*c* of the ferrite core 55. At a position in the center protrusion 55*a* of the ferrite core 55 that corresponds to the curved section of the demagnetizing coil 86 is provided a cutout not shown, which prevents the center protrusion 55*a* from interfering with the curved section of the demagnetizing coil 86.

A first temperature sensor 57 composed of thermostat is provided so as to extend through the gap 56*b* of the exciting coil 56 and through the gap 86*b* of the demagnetizing coil 86 and so as to face the transfer felt 51.

A second temperature sensor 58 is provided above the fixing roller 53 so as to face the transfer felt 51.

The color printer has a CPU 70 for controlling operation of the whole printer, and a temperature controlling circuit 60 having the same configuration that the temperature controlling circuit 20 shown in FIG. 5A has.

In a printing operation, the temperature of the transfer felt 51 is controlled to a target temperature according to a printing mode by the temperature controlling circuit 60. Then a paper form 92 is conveyed through the nipping part between the transfer felt 51 and the pressurizing roller 54, and a toner image 93 formed on the transfer felt 51 is thereby transferred onto and fixed to the paper form 92.

If the paper form 92 that is conveyed then is of A3 size with the largest width, the change-over switch 30 is turned off in accordance with the flow of FIG. 6. Thus the demagnetizing coil 86 is opened so as not to function. Accordingly, satisfactory fixing can be achieved over the whole area of the sheet having the largest width.

If the paper form 92 that is conveyed then is of B4 size, for example, smaller than A3 size, the change-over switch 30 is turned on in accordance with the flow of FIG. 6. Thus the demagnetizing coil 86 is closed. Then at an end portion of the transfer felt 51 with respect to the width direction of the paper form 92 (in a region where the demagnetizing coil 86 exists), a change of magnetic flux produced by the exciting coil 56 causes not only induced current (eddy current) in the transfer felt 51 but also a back electromotive force (and a resultant current) in the demagnetizing coil 86. Thus the eddy current in the transfer felt 51 is reduced and temperature increase in the end portion of the transfer felt 51 is thereby prevented. As a result, stability and safety in the temperature control for the transfer felt 51 can be improved.

In the fixer, besides, the exciting coil 56 exists between the transfer felt 51 and the demagnetizing coil 86, and therefore heat capacity (temperature) of the demagnetizing coil 86 itself exerts little influence upon a temperature distribution on the transfer felt 51. Thus stability in the temperature control for the transfer felt 51 can further be improved.

The invention being thus described, it will be obvious that the same may be varied in many ways. Such variations are not be regarded as a departure from the spirit and scope of the invention, and all such modifications as would be obvious to one skilled in the art are intended to be included within the scope of the following claims.

What is claimed is:

1. An induction heating device for inductively heating an object to be heated which is formed of conductive material, comprising:

a holder which comprises a ferrite core and is positioned outside the object;

an exciting coil for inductively heating the object, wherein the exciting coil is composed of a plurality of turns of conductor forming a layer which is supported by the holder and is positioned along the object; and a demagnetizing coil which is positioned along the layer of the exciting coil and in which a back electromotive force is induced in accordance with a magnetic field produced by the exciting coil, so as to cancel the magnetic field, wherein the demagnetizing coil is provided between the exciting coil and the ferrite core of the holder.

2. An induction heating device as claimed in claim 1, further comprising an insulating layer between the demagnetizing coil and the exciting coil.

3. An induction heating device as claimed in claim 1, further comprising a switching circuit for opening and closing the demagnetizing coil.

4. An induction heating device for inductively heating an object to be heated which is formed of conductive material, comprising:

a holder which comprises a ferrite core and is positioned outside the object;

an exciting coil for inductively heating the object, wherein the exciting coil is composed of a plurality of turns of conductor forming a layer which is supported by the holder and is positioned along the object; and a demagnetizing coil which is positioned along the layer of the exciting coil and in which a back electromotive force is induced in accordance with a magnetic field produced by the exciting coil, so as to cancel the magnetic field, wherein the demagnetizing coil forms a layer and is positioned so as to form the same layer as the exciting coil forms.

5. An induction heating fixing device of induction heating type for fixing a toner image to a sheet while conveying the sheet, comprising:

a fixing member formed of conductive material;

a pressurizing member for temporarily pinching the sheet being conveyed, between the pressurizing member and the fixing member, wherein the pressurizing member is provided in pressure contact with the fixing member;

a holder which comprises a ferrite core and is positioned outside the fixing member;

an exciting coil for inductively heating the fixing member, wherein the exciting coil is composed of a plurality of turns of conductor forming a layer which is supported by the holder and is positioned along the fixing member; and a demagnetizing coil which is positioned along the layer of the exciting coil and in which a back electromotive force is induced in accordance with a magnetic field produced by the exciting coil, so as to cancel the magnetic field, wherein the demagnetizing coil is provided between the exciting coil and the ferrite core of the holder.

6. An induction heating fixing device as claimed in claim 5, further comprising an insulating layer between the demagnetizing coil and the exciting coil.

7. An induction heating fixing device as claimed in claim 5, wherein the demagnetizing coil is positioned within a narrower region than the exciting coil is, with respect to width direction of the sheet that is conveyed through pinching part between the fixing member and the pressurizing member.

8. An induction heating fixing device as claimed in claim 5, further comprising a switching circuit for opening and closing the demagnetizing coil.

9. An induction heating fixing device as claimed in claim 8, wherein the switching circuit closes the demagnetizing coil only on occasion of fixing to a sheet of a smaller size than a predetermined size.

10. An induction heating fixing device of induction heating type for fixing a toner image to a sheet while conveying the sheet, comprising:

a fixing member formed of conductive material;

a pressurizing member for temporarily pinching the sheet being conveyed, between the pressurizing member and the fixing member, wherein the pressurizing member is provided in pressure contact with the fixing member;

a holder which comprises a ferrite core and is positioned outside the fixing member;

an exciting coil for inductively heating the fixing member, wherein the exciting coil is composed of a plurality of turns of conductor forming a layer which is supported by the holder and is positioned along the fixing member; and a demagnetizing coil which is positioned along the layer of the exciting coil and in which a back electromotive force is induced in accordance with a magnetic field produced by the exciting coil, so as to cancel the magnetic field, wherein the demagnetizing coil forms a layer and is positioned so as to form the same layer as the exciting coil forms.

11. An image forming apparatus comprising an image forming unit for forming a toner image and an induction heating fixing device of induction heating type for fixing to a sheet the toner image formed by the image forming unit while conveying the sheet, further comprising:

a fixing member formed of conductive material;

a pressurizing member for temporarily pinching the sheet being conveyed between the pressurizing member and the fixing member, wherein the pressurizing member is provided in pressure contact with the fixing member;

a holder which comprises a ferrite core and is positioned outside the fixing member;

an exciting coil for inductively heating the fixing member, wherein the exciting coil is composed of a plurality of turns of conductor forming a layer which is supported by the holder and is positioned along the fixing member; and a demagnetizing coil which is positioned along the layer of the exciting coil and in which a back electromotive force is induced in accordance with a magnetic field produced by the exciting coil, so as to cancel the magnetic fields, wherein the demagnetizing coil is provided between the exciting coil and the ferrite core of the holder.

* * * * *